US008491068B2

(12) United States Patent
Weng et al.

(10) Patent No.: US 8,491,068 B2
(45) Date of Patent: Jul. 23, 2013

(54) DRAWER ASSEMBLY THAT IS LOCKED AUTOMATICALLY WHEN IT IS CLOSED

(76) Inventors: Kuo-Chan Weng, Xinzhuang Village (TW); Jung-Hung Weng, Xinzhuang Village (TW)

( * ) Notice: Subject to any disclaimer, the term of this patent is extended or adjusted under 35 U.S.C. 154(b) by 189 days.

(21) Appl. No.: 13/039,448

(22) Filed: Mar. 3, 2011

(65) Prior Publication Data

US 2012/0223630 A1 Sep. 6, 2012

(51) Int. Cl.
*A47B 95/02* (2006.01)

(52) U.S. Cl.
USPC ..... 312/332.1

(58) Field of Classification Search
USPC ..... 312/332.1, 333
See application file for complete search history.

(56) References Cited

U.S. PATENT DOCUMENTS

| | | | | | |
|---|---|---|---|---|---|
| 1,963,954 | A * | 6/1934 | Clark | ..... | 312/332.1 |
| 3,239,298 | A * | 3/1966 | McCarthy | ..... | 312/234.3 |
| 3,252,746 | A * | 5/1966 | Kafferlin et al. | ..... | 312/234.3 |
| 3,294,463 | A * | 12/1966 | Kafferlin et al. | ..... | 312/234.5 |
| 3,782,800 | A * | 1/1974 | Remington et al. | ..... | 312/333 |
| 5,292,191 | A * | 3/1994 | Slivon | ..... | 312/332.1 |
| 6,527,353 | B1 * | 3/2003 | Bradfish et al. | ..... | 312/332.1 |
| 6,547,289 | B1 * | 4/2003 | Greenheck et al. | ..... | 292/126 |
| 7,048,347 | B1 * | 5/2006 | Liu | ..... | 312/332.1 |
| 7,552,950 | B2 * | 6/2009 | Scheffy et al. | ..... | 292/95 |
| 2006/0103278 | A1 * | 5/2006 | Bousquet | ..... | 312/332.1 |
| 2009/0102333 | A1 * | 4/2009 | Weng | ..... | 312/222 |

* cited by examiner

*Primary Examiner* — Hanh V Tran
(74) *Attorney, Agent, or Firm* — Alan Kamrath; Kamrath IP Lawfirm, P.A.

(57) ABSTRACT

A drawer assembly includes a housing, a drawer body retractably mounted on the housing, two locking members mounted in the housing, and a control bar pivotally mounted on the drawer body and having two opposite ends each provided with a locking end that is movable to lock a respective one of the locking members. Thus, when the drawer body is retracted into and received in the housing, the locking end of the control bar is locked onto the respective locking member to lock the drawer body onto the housing so that the drawer body is locked onto the housing when the drawer assembly is closed and will not be moved outward from the housing when the drawer assembly is moved or declined to facilitate the user moving or transporting the drawer assembly.

9 Claims, 8 Drawing Sheets

DRAWER ASSEMBLY THAT IS LOCKED AUTOMATICALLY WHEN IT IS CLOSED

BACKGROUND OF THE INVENTION

1. Field of the Invention

The present invention relates to a drawer and, more particularly, to a drawer assembly for a desk, cabinet, rack and the like.

2. Description of the Related Art

A conventional drawer assembly comprises a housing and a drawer body retractably mounted on the housing. Thus, the drawer body can be retracted into the housing to close the drawer assembly and can be pulled outward from the housing to open the drawer assembly. However, the drawer body will be moved outward from the housing easily when the drawer assembly is transported or declined, thereby causing inconvenience or even danger to the user when moving or transporting the drawer assembly.

BRIEF SUMMARY OF THE INVENTION

In accordance with the present invention, there is provided a drawer assembly, comprising a housing, a drawer body retractably mounted on the housing, two locking members mounted in the housing, and a control bar pivotally mounted on the drawer body to move in concert with the drawer body and having two opposite ends each provided with a locking end that is movable to lock a respective one of the two locking members when the drawer body is retracted into and received in the housing so as to lock the drawer body onto the housing.

The primary objective of the present invention is to provide a drawer assembly that is locked automatically when it is closed.

According to the primary advantage of the present invention, when the drawer body is retracted into and received in the housing, the locking end of the control bar is locked onto the respective locking member to lock the drawer body onto the housing so that the drawer body is locked onto the housing when the drawer assembly is closed and will not be moved outward from the housing when the drawer assembly is moved or declined to facilitate the user moving or transporting the drawer assembly.

According to another advantage of the present invention, the locking end of the control bar is directly locked onto the respective locking member when the drawer body is retracted into and received in the housing, so that the drawer body is locked onto the housing automatically when the drawer assembly is closed to facilitate the user locking the drawer assembly.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
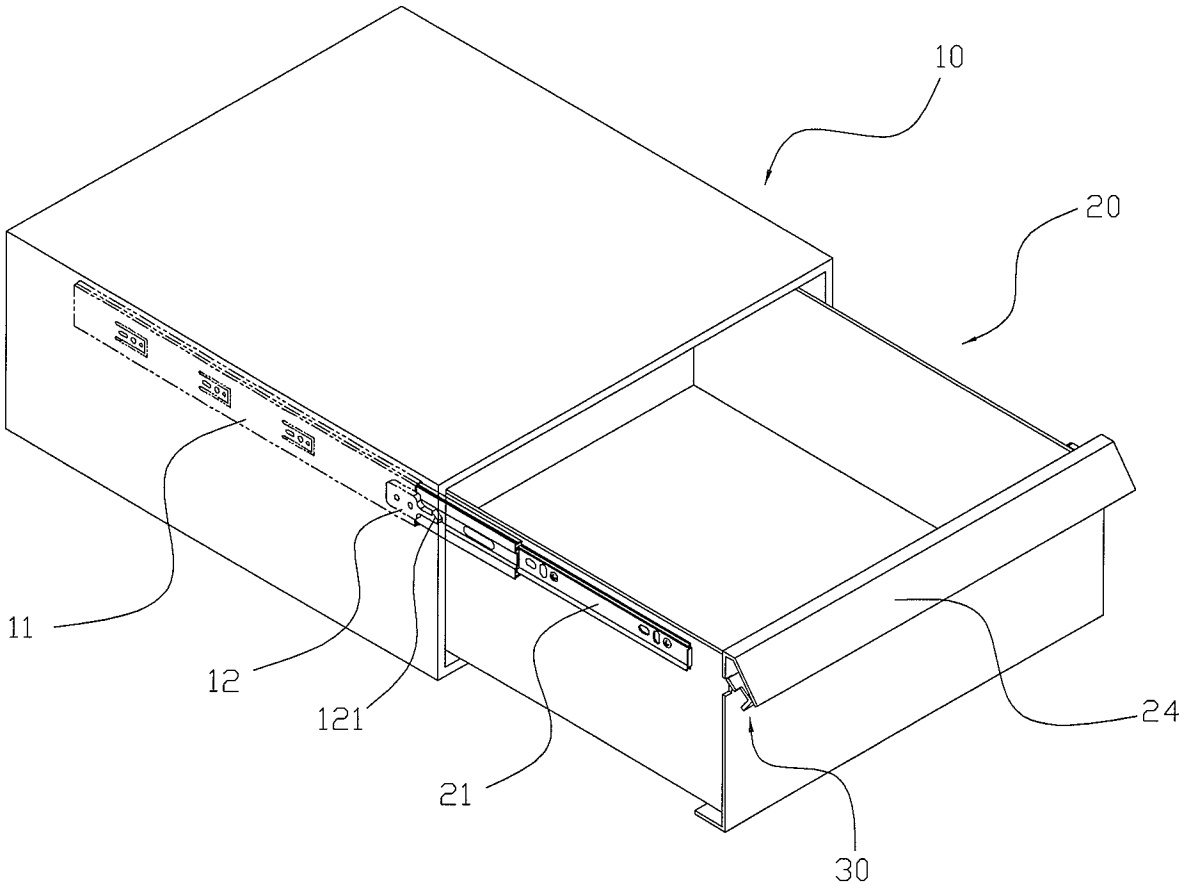
FIG. 1 is a perspective view of a drawer assembly in accordance with the preferred embodiment of the present invention.
Figure 2:
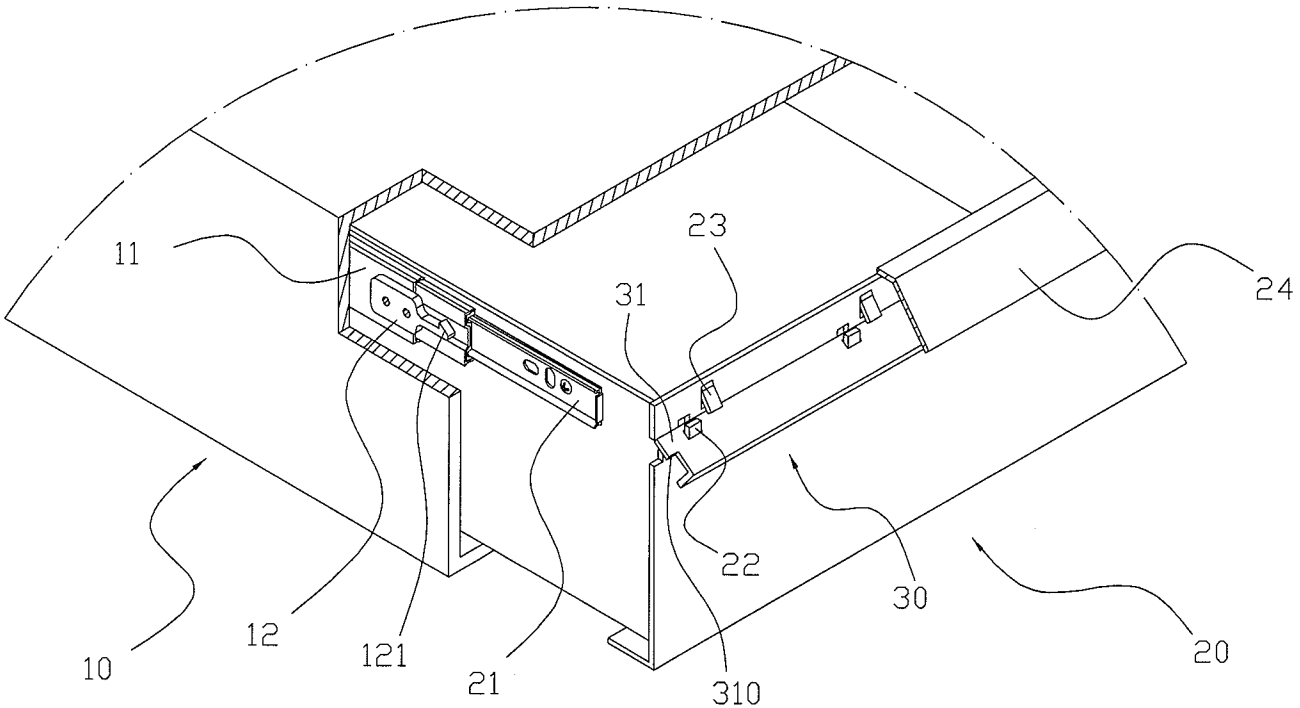
FIG. 2 is a partially perspective broken cross-sectional view of the drawer assembly as shown in FIG. 1.
Figure 3:
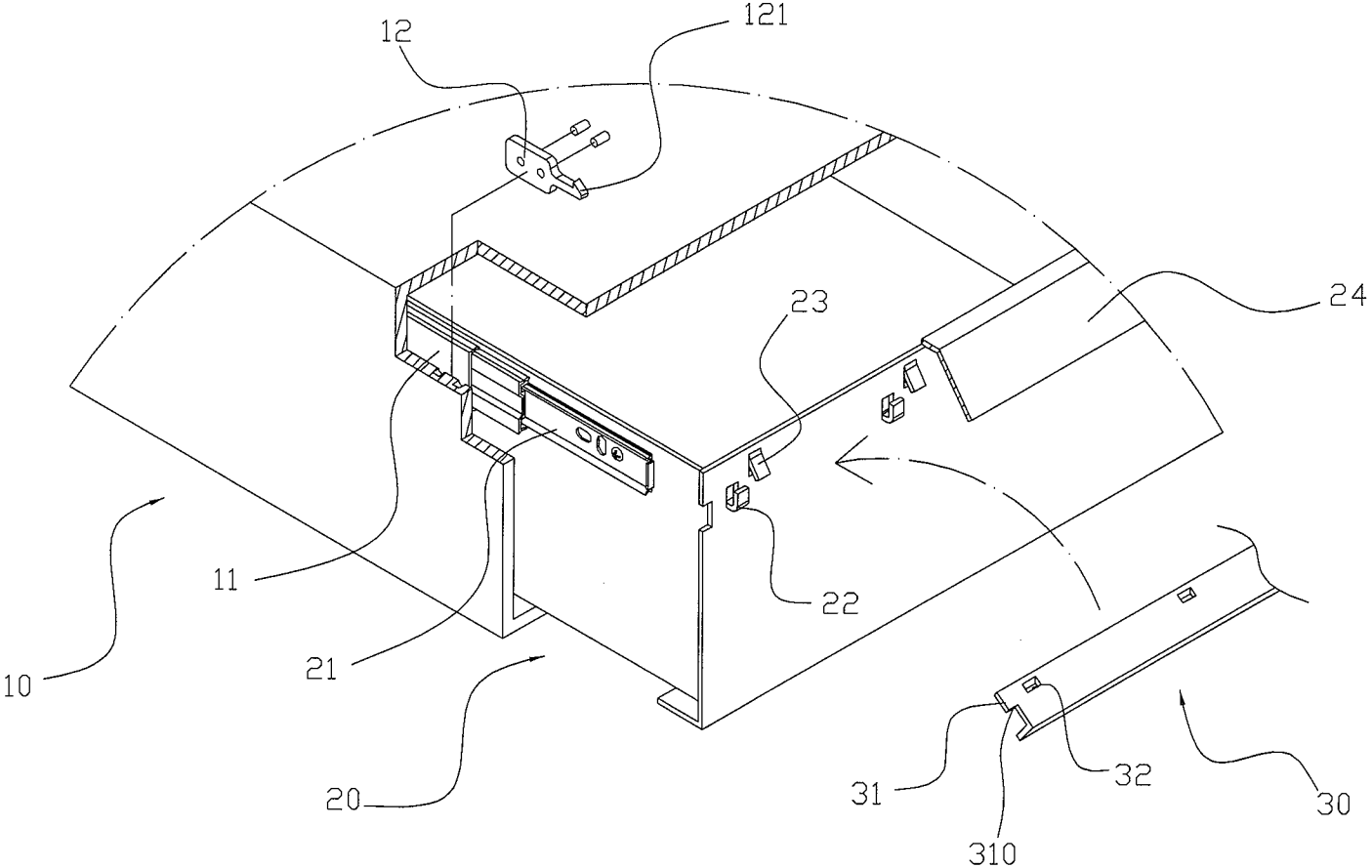
FIG. 3 is an exploded perspective view of the drawer assembly as shown in FIG. 2.

Referring to the drawings and initially to FIGS. 1-3, a drawer assembly in accordance with the preferred embodiment of the present invention comprises a housing 10, a drawer body 20 retractably mounted on the housing 10, two locking members 12 mounted in the housing 10, a control bar 30 pivotally mounted on the drawer body 20 to move in concert with the drawer body 20 and having two opposite ends each provided with a locking end 31 that is movable to lock a respective one of the two locking members 12 when the drawer body 20 is retracted into and received in the housing 10 so as to lock the drawer body 20 onto the housing 10, a pull handle 24 mounted on the drawer body 20 to cover the control bar 30, a guide track 11 mounted in the housing 10, and a sliding rail 21 mounted on the drawer body 20 to move in concert with the drawer body 20 and slidably mounted in the guide track 11 to guide movement of the drawer body 20 relative to the housing 10.

The drawer body 20 has a surface provided with a plurality of mounting brackets 22 for mounting the control bar 30 and a plurality of limit plates 23 for limiting the control bar 30. The mounting brackets 22 are covered by the pull handle 24. Each of the mounting brackets 22 has a substantially L-shaped profile. The limit plates 23 are covered by the pull handle 24. Each of the limit plates 23 is located above each of the mounting brackets 22. Each of the limit plates 23 is inclined relative to the surface of the drawer body 20 and is extended outward and downward from the surface of the drawer body 20.

The pull handle 24 is inclined relative to the surface of the drawer body 20 and is extended outward and downward from the surface of the drawer body 20.

Each of the two locking members 12 is fixedly mounted on an inner wall of the housing 10 and is fully hidden in the housing 10. Each of the two locking members 12 has a distal end provided with a locking hook 121 detachably locked onto the respective locking end 31 of the control bar 30.

The control bar 30 is disposed between the drawer body 20 and the pull handle 24 and is limited between the mounting brackets 22 and the limit plates 23 as shown in FIG. 2. The control bar 30 has a surface provided with a plurality of mounting holes 32 pivotally mounted on the mounting brackets 22 respectively. The control bar 30 has a substantially L-shaped profile and is inclined relative to the surface of the drawer body 20. The locking end 31 of the control bar 30 has a side provided with a locking recess 310 locked onto the locking hook 121 of the respective locking member 12.

Figure 4:
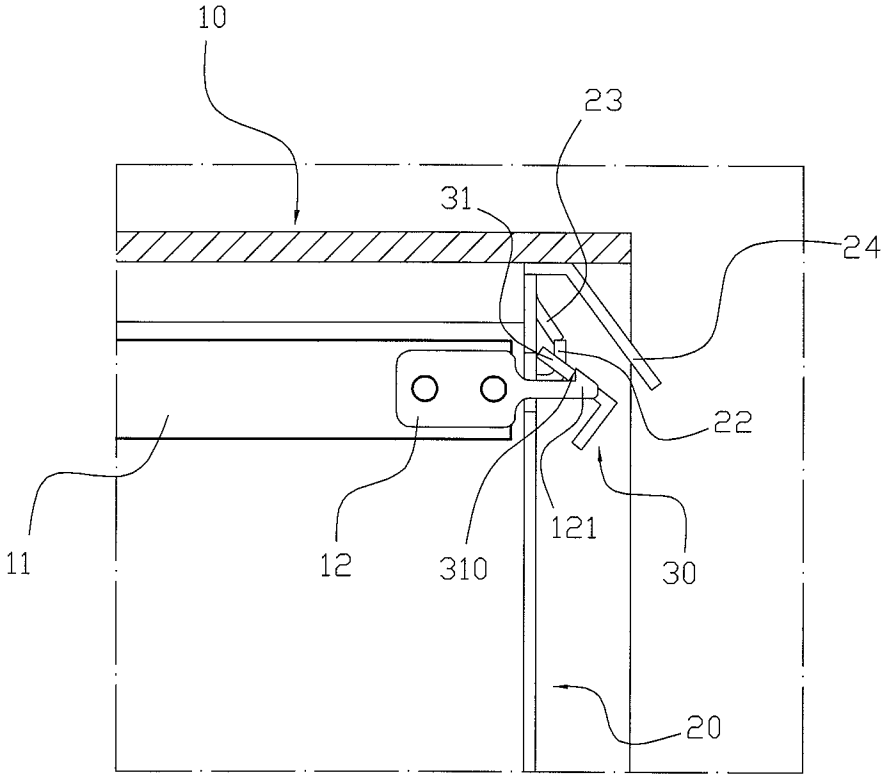
FIG. 4 is a side operational assembly view of the drawer assembly as shown in FIG. 2.
Figure 5:
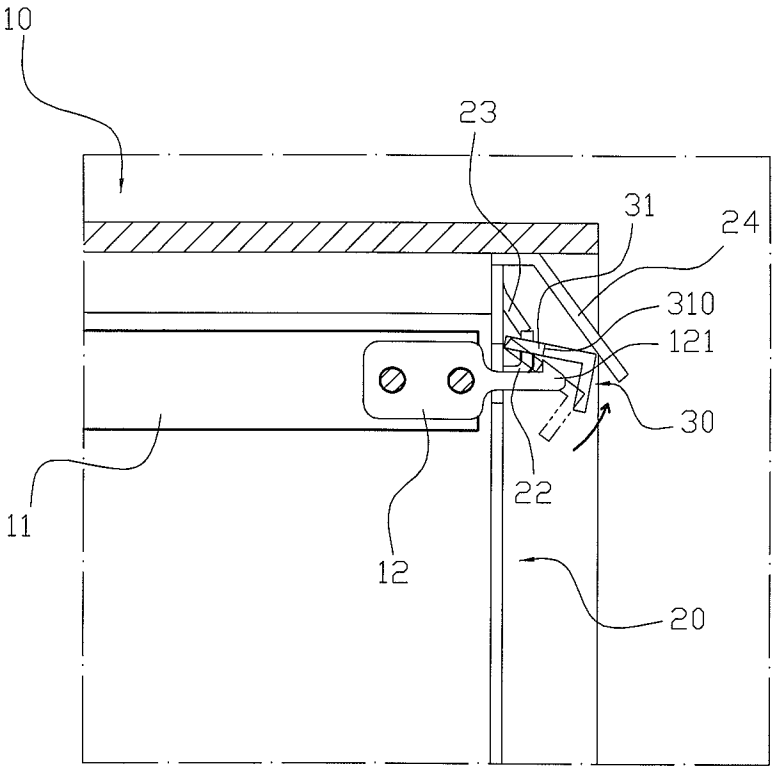
FIG. 5 is a schematic operational view of the drawer assembly as shown in FIG. 4.
Figure 6:
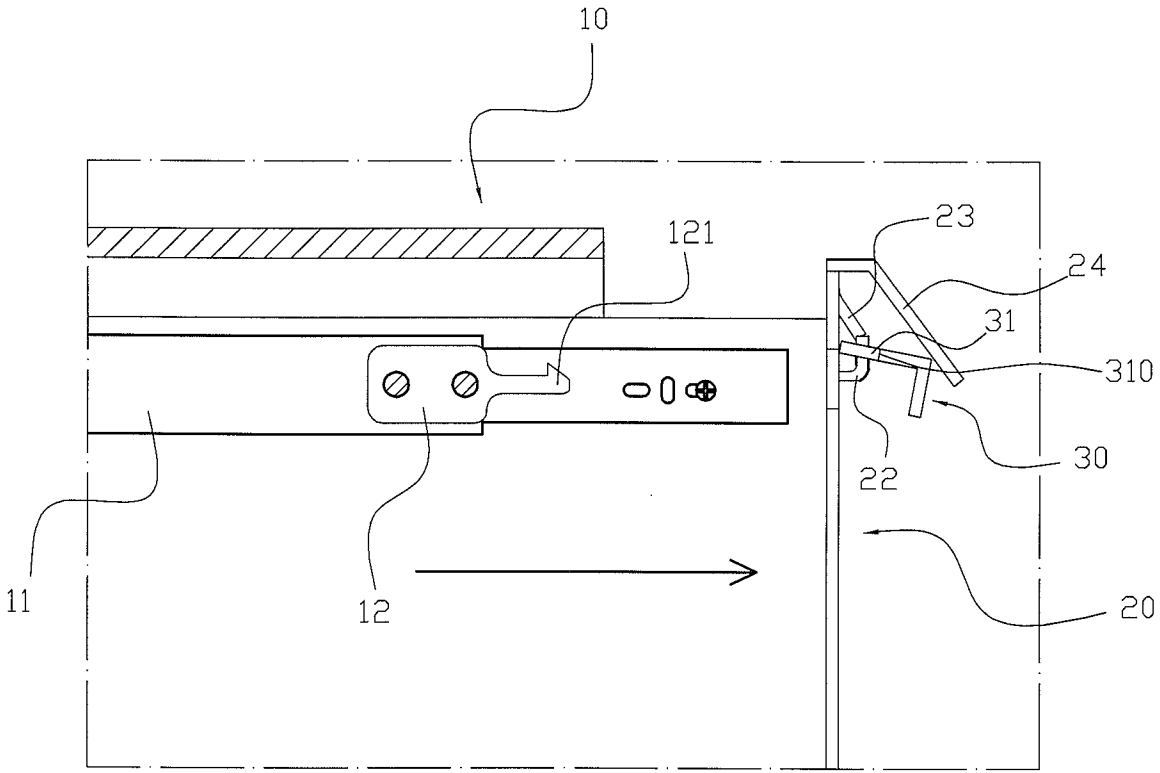
FIG. 6 is a schematic operational view of the drawer assembly as shown in FIG. 5.

In operation, referring to FIGS. 4-6 with reference to FIGS. 1-3, when the drawer body 20 is retracted into and received in the housing 10, the control bar 30 touches and is pushed by the respective locking member 12 to pivot upward relative to the drawer body 20 so that the locking end 31 of the control bar 30 is locked onto the locking hook 121 of the respective locking member 12 as shown in FIG. 4 to lock the drawer body 20 onto the housing 10. In such a manner, the drawer body 20 is locked onto the housing 10 when the drawer assembly is closed so that the drawer body 20 will not be moved outward from the housing 10 when the drawer assembly is moved or declined to facilitate a user moving or transporting the drawer assembly. On the contrary, when the control bar 30 is driven upward by the user to pivot upward toward the pull handle 24, the locking end 31 of the control bar 30 is detached from the locking hook 121 of the respective locking member 12 as shown in FIG. 5 to unlock the drawer body 20 from the housing 10. In such a manner, the drawer body 20 can be moved outward from the housing 10 as shown in FIG. 6 to open the drawer assembly.

Figure 7:
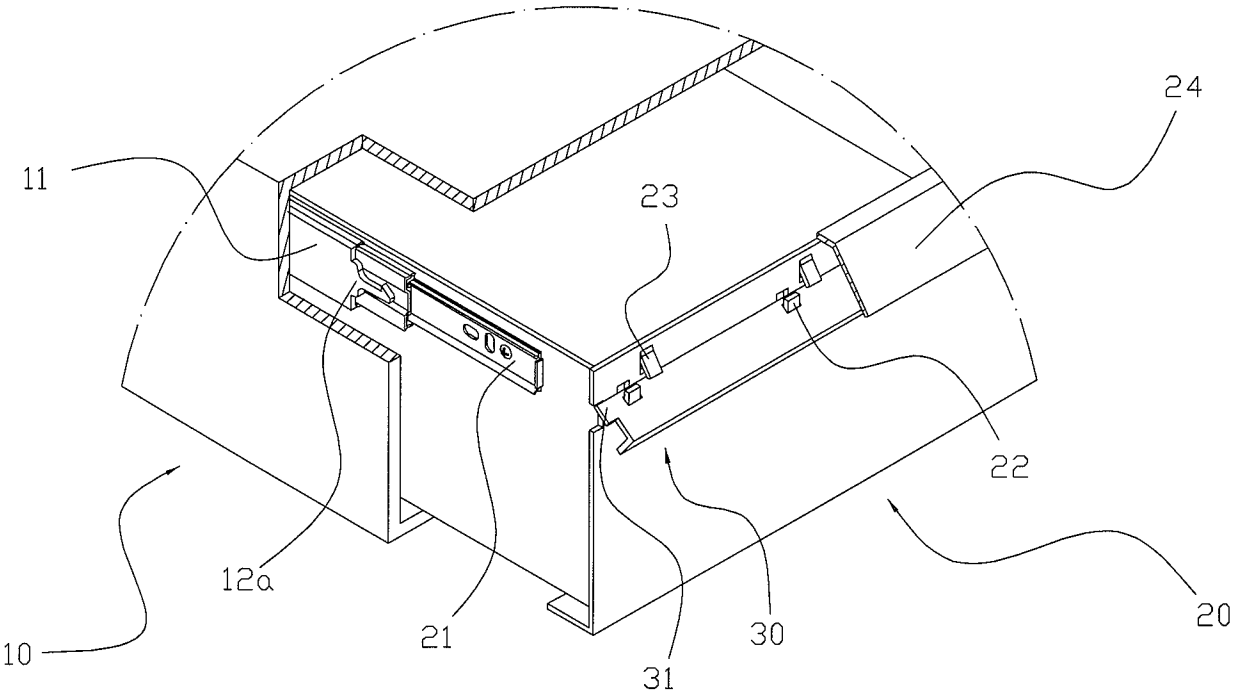
FIG. 7 is a partially perspective broken cross-sectional view of a drawer assembly in accordance with another preferred embodiment of the present invention.

As shown in FIG. 7, each of the two locking members 12*a* is integrally formed on and protruded outward from a distal end of the guide track 11. Preferably, each of the two locking members 12*a* is located at a middle position of the guide track 11.

Figure 8:
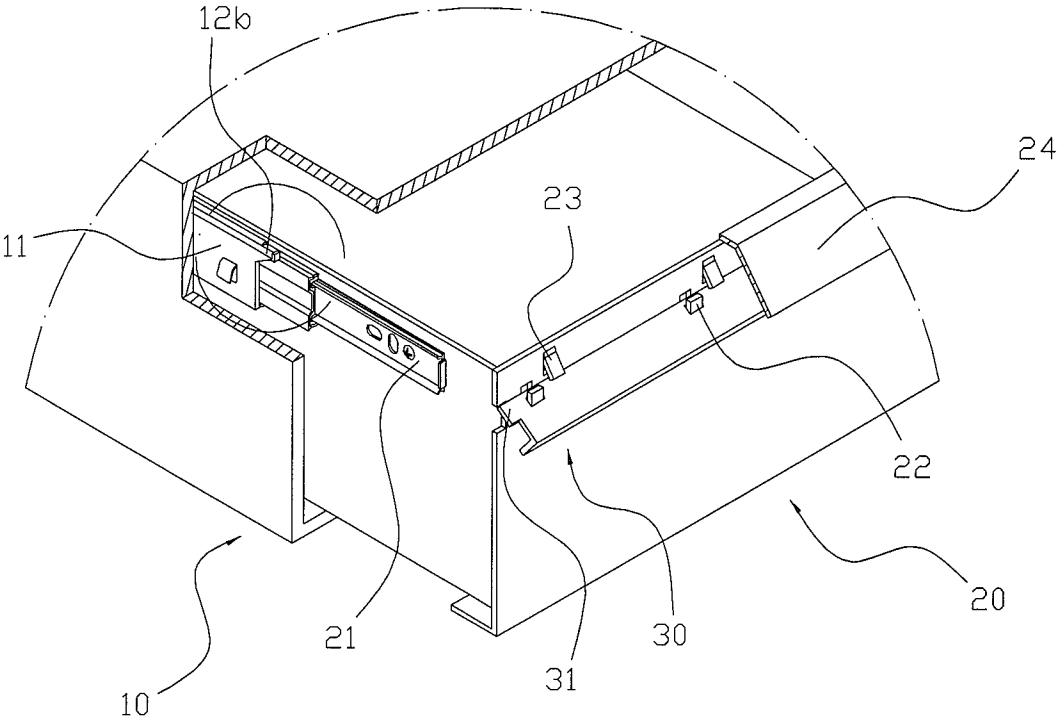
FIG. 8 is a partially perspective broken cross-sectional view of a drawer assembly in accordance with another preferred embodiment of the present invention.
Figure 9:
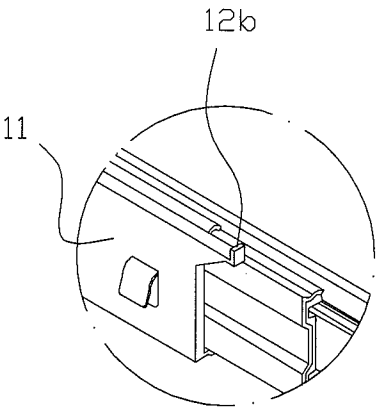
FIG. 9 is a locally enlarged view of the drawer assembly as shown in FIG. 8.

As shown in FIGS. 8 and 9, each of the two locking members 12*b* is located at a top position of the guide track 11.

Accordingly, when the drawer body 20 is retracted into and received in the housing 10, the locking end 31 of the control bar 30 is locked onto the respective locking member 12 to lock the drawer body 20 onto the housing 10 so that the drawer body 20 is locked onto the housing 10 when the drawer assembly is closed and will not be moved outward from the housing 10 when the drawer assembly is moved or declined to facilitate the user moving or transporting the drawer assembly. In addition, the locking end 31 of the control bar 30 is directly locked onto the respective locking member 12 when the drawer body 20 is retracted into and received in the housing 10, so that the drawer body 20 is locked onto the housing 10 automatically when the drawer assembly is closed to facilitate the user locking the drawer assembly.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A drawer assembly, comprising:

a housing;

a drawer body retractably mounted on the housing;

two locking members mounted in the housing; and a control bar pivotally mounted on the drawer body to move in concert with the drawer body and having two opposite ends each provided with a locking end that is movable to lock a respective one of the two locking members when the drawer body is retracted into and received in the housing so as to lock the drawer body onto the housing; wherein:

the locking end of the control bar extends and protrudes outward from an end face of each of the two opposite ends of the control bar; wherein the drawer body has a surface provided with a plurality of mounting brackets for mounting the control bar and a plurality of limit plates for limiting the control bar, each of the limit plates located above a respective mounting bracket, inclined relative to the surface of the drawer body and extended outward and downward from the surface of the drawer body; the control bar has a surface provided with a plurality of mounting holes pivotally mounted on the mounting brackets respectively and being limited between the mounting brackets and the limit plates; and each of the mounting holes of the control bar is pivotable about a respective one of the mounting brackets, and each locking end of the control bar is pivotable about the mounting brackets when the control bar is pushed by the locking member.

2. The drawer assembly of claim 1, wherein the drawer assembly further comprises:

a pull handle mounted on the drawer body to cover the control bar.

3. The drawer assembly of claim 1, wherein the drawer assembly further comprises:

a guide track mounted in the housing;

a sliding rail mounted on the drawer body to move in concert with the drawer body and slidably mounted in the guide track to guide movement of the drawer body relative to the housing.

4. The drawer assembly of claim 1, wherein each of the two locking members has a distal end provided with a locking hook detachably locked onto the respective locking end of the control bar.

5. The drawer assembly of claim 1, wherein the control bar is disposed between the drawer body and the pull handle;

the control bar is inclined relative to the surface of the drawer body.

6. The drawer assembly of claim 1, wherein the mounting brackets are covered by the pull handle;

the limit plates are covered by the pull handle;

the pull handle is inclined relative to the surface of the drawer body and is extended outward and downward from the surface of the drawer body;

each of the mounting brackets has a substantially L-shaped profile.

7. The drawer assembly of claim 3, wherein each of the two locking members is integrally formed on and protruded outward from a distal end of the guide track.

8. The drawer assembly of claim 4, wherein the locking end of the control bar has a stepped shape and has a side provided with a locking recess locked onto the locking hook of the respective locking member.

9. The drawer assembly of claim 1, wherein each of the two locking members is fixedly mounted on an inner wall of the housing and is fully hidden in the housing.

* * * * *